US011091867B2

(12) United States Patent
Hoppe et al.

(10) Patent No.: US 11,091,867 B2
(45) Date of Patent: Aug. 17, 2021

(54) LAUNDRY WASHING MACHINE INCORPORATING DISTANCE SENSOR

(71) Applicant: Midea Group Co., Ltd., Foshan (CN)

(72) Inventors: Christopher G. Hoppe, Louisville, KY (US); Phillip C. Hombroek, Louisville, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 303 days.

(21) Appl. No.: 16/356,560

(22) Filed: Mar. 18, 2019

(65) Prior Publication Data

US 2019/0211493 A1 Jul. 11, 2019

Related U.S. Application Data

(62) Division of application No. 15/273,617, filed on Sep. 22, 2016, now Pat. No. 10,273,623.

(51) Int. Cl.
*D06F 34/18* (2020.01)
*D06F 39/14* (2006.01)
(Continued)

(52) U.S. Cl.
CPC ..... *D06F 34/18* (2020.02); *D06F 33/00* (2013.01); *D06F 34/28* (2020.02); *D06F 35/006* (2013.01);
(Continued)

(58) Field of Classification Search
CPC .... D06F 18/00; D06F 25/00; D06F 33/00–76; D06F 34/00–34; D06F 35/00; D06F 35/001; D06F 35/002; D06F 35/003; D06F 35/004; D06F 35/005; D06F 35/006; D06F 35/007; D06F 35/008; D06F 37/00; D06F 37/203; D06F 37/22; D06F 37/225; D06F 37/24; D06F 37/245; D06F 37/42; D06F 39/00; D06F 39/14; D06F 58/00; D06F 58/02; D06F 58/04; D06F 58/20; D06F 58/203; D06F 58/30; D06F 58/32–52; D06F 2101/00–20;
(Continued)

(56) References Cited

U.S. PATENT DOCUMENTS 5,515,565 A 5/1996 Maddix et al.
5,739,534 A 4/1998 Estenson et al.
(Continued)

FOREIGN PATENT DOCUMENTS

CN 101377045 A 1/2000
CN 202247394 U 5/2012
(Continued)

OTHER PUBLICATIONS

International Search Report and Written Opinion issued in Application No. PCT/CN2017/101432 dated Dec. 20, 2017.
(Continued)

*Primary Examiner* — David G Cormier
(74) *Attorney, Agent, or Firm* — Middleton Reutlinger

(57) ABSTRACT

A laundry washing machine and method may use a distance sensor to determine dry and wet distance values associated with a load disposed in a wash tub, and dynamically configure a wash cycle based upon the determined values. In some instances, the distance sensor may also be used to detect an excessive fluid level, excessive foaming, or a floating item in the wash tub.

18 Claims, 7 Drawing Sheets

(51) Int. Cl.
*D06F 35/00* (2006.01)
*D06F 33/00* (2020.01)
*D06F 34/28* (2020.01)

(52) U.S. Cl.
CPC ..... *D06F 39/14* (2013.01); *D06F 2202/10* (2013.01); *D06F 2202/12* (2013.01); *D06F 2204/065* (2013.01); *D06F 2204/088* (2013.01); *D06F 2222/00* (2013.01); *D06F 2224/00* (2013.01)

(58) Field of Classification Search
CPC . D06F 2103/00–70; D06F 2105/00–62; D06F 2202/00–12; D06F 2204/00–10; D06F 2210/00; D06F 2212/00–06; D06F 2214/00; D06F 2216/00; D06F 2220/00; D06F 2222/00; D06F 2224/00; D06F 2226/00
See application file for complete search history.

(56) References Cited

U.S. PATENT DOCUMENTS

| | | | |
|---|---|---|---|
| 5,822,819 | A | 10/1998 | Ferragut et al. |
| 6,784,997 | B2 | 8/2004 | Lorenz et al. |
| 7,363,780 | B2 | 4/2008 | Lee et al. |
| 7,820,995 | B2 | 10/2010 | Gadini et al. |
| 9,243,987 | B2 | 1/2016 | Chanda et al. |
| 2012/0246835 | A1 | 10/2012 | Ashrafzadeh et al. |
| 2013/0247307 | A1 | 9/2013 | Park et al. |
| 2014/0326067 | A1 | 11/2014 | Chanda et al. |
| 2015/0128357 | A1 | 5/2015 | Koo |
| 2015/0354122 | A1 | 12/2015 | Kwon et al. |

FOREIGN PATENT DOCUMENTS

| | | |
|---|---|---|
| CN | 102926163 A | 2/2013 |
| CN | 104746293 | 7/2015 |
| CN | 204959394 | 1/2016 |
| KR | 19990049218 | 7/1999 |
| KR | 20000004075 | 1/2000 |
| WO | WO2016015765 | 2/2016 |

OTHER PUBLICATIONS

Machine Translation of Won, KR 2000-0004075 A, Jan. 2000 (Year 2000).

Measurement Specialties, Inc, Sensor Solutions for Home Appliances, Measurement Specialties-Sensing Your World, Sensor Solutions for Home Appliances, 12 Pages, dated Aug. 31, 2014.

U.S. Patent Office; Office Action issued in U.S. Appl. No. 15/273,617, dated Jul. 12, 2018.

U.S. Patent Office; Notice of Allowance issued in U.S. Appl. No. 15/273,617 dated Jan. 9, 2019.

LAUNDRY WASHING MACHINE INCORPORATING DISTANCE SENSOR

BACKGROUND

Laundry washing machines are used in many single-family and multi-family residential applications to clean clothes and other fabric items. Due to the wide variety of items that may need to be cleaned by a laundry washing machine, many laundry washing machines provide a wide variety of user-configurable settings to control various aspects of a wash cycle such as water temperatures and/or amounts, agitation, soaking, rinsing, spinning, etc. The settings cycle can have an appreciable effect on washing performance, as well as on energy and/or water consumption, so it is generally desirable for the settings used by a laundry washing machine to appropriately match the needs of each load washed by the machine.

Some laundry washing machines also support user selection of load types, typically based on the types of fabrics and/or items in the load. Some laundry washing machines, for example, have load type settings such as colors, whites, delicates, cottons, permanent press, towels, bedding, heavily soiled items, etc. These manually-selectable load types generally represent specific combinations of settings that are optimized for particular load types so that a user is not required to select individual values for each of the controllable settings of a laundry washing machine.

While manual load type selection in many cases simplifies a user's interaction with a laundry washing machine, such manual selection still can lead to suboptimal performance due to, for example, user inattentiveness or lack of understanding. Therefore, a significant need continues to exist in the art for a manner of optimizing the performance of a laundry washing machine for different types of loads, as well as reducing the burden on users when interacting with a laundry washing machine.

SUMMARY

The herein-described embodiments address these and other problems associated with the art by providing a laundry washing machine and method that utilize a distance sensor to determine dry and wet distance values associated with a height of a load disposed in a wash tub respectively before and after water has been dispensed into the wash tub, such that one or more settings of a wash cycle may be dynamically configured based upon the dry and wet distance values. In some instances, for example, the dry and wet distance values may be used to determine a fabric type and/or a load size such that various operating settings of a wash cycle may be dynamically adapted for different loads.

Therefore, consistent with one aspect of the invention, a laundry washing machine may include a wash tub disposed within a housing, a water inlet configured to dispense water into the wash tub, a distance sensor oriented to sense a distance within the wash tub, and a controller coupled to the water inlet and the distance sensor, the controller configured to perform a wash cycle on a load disposed in the wash tub. The controller may be configured to determine dry and wet distance values associated with the load using the distance sensor, the dry distance value associated with a height of the load in the wash tub prior to dispensing of water into the wash tub by the water inlet and the wet distance value associated with a height of the load in the wash tub after water is dispensed into the wash tub, and dynamically configure one or more settings of the wash cycle based upon the determined dry and wet distance values.

In some embodiments, the distance sensor is a laser distance sensor, an ultrasonic distance sensor or a three-dimensional imaging sensor. Some embodiments also include one or more additional sensors, where the controller is configured to dynamically configure the one or more settings of the wash cycle based upon data from one or more of the additional sensors. In addition, in some embodiments, the one or more additional sensors includes a digital camera configured to image a top profile of the load, and in some embodiments, the controller is configured to detect a potential out-of-balance load based upon the imaged top profile.

In addition, in some embodiments, the distance sensor is mounted on a hinged door coupled to the housing and oriented to sense the distance within the wash tub when the hinged door is in a closed position, and the distance sensor is automatically disabled when the hinged door is in an open position. Some embodiments further include a rotatable wash basket disposed in the wash tub, where the controller is configured to determine the dry and wet distance values based upon distances sensed by the distance sensor during rotation of the wash basket. In some embodiments, the controller is configured to sense a potential out-of-balance load based upon distance variations sensed by the distance sensor during rotation of the wash basket, in some embodiments, the controller is configured to average multiple sensed distances from the distance sensor during rotation of the wash basket, and in some embodiments, the dry distance value is a first dry distance value, and the controller is configured to determine a second dry distance value associated with the load using the distance sensor, and wherein the controller is configured to temporarily increase a rotational speed of the wash basket, determine the first dry distance value based upon a distance sensed by the distance sensor before temporarily increasing the rotational speed of the wash basket, determine the second dry distance value based upon a distance sensed by the distance sensor after temporarily increasing the rotational speed of the wash basket, and dynamically configure the one or more settings of the wash cycle further based upon the second dry distance value. Further, in some embodiments the first and second dry distance values and the wet distance value are each based upon distance from a reference point to a top surface of the load, and the controller is further configured to determine a first dry distance ratio between the first dry distance value and a distance from the reference point to a base of the wash basket, determine a second dry distance ratio between the second dry distance value and a distance from the reference point to a base of the wash basket, determine a first wet distance ratio between the first dry distance value and the wet distance value, determine a second wet distance ratio between the second dry distance value and the wet distance value, and dynamically configure the one or more settings of the wash cycle based upon the first and second dry distance ratios and the first and second wet distance ratios.

In some embodiments, the controller is configured to determine a load size based upon the dry and wet distance values, and in some embodiments, the controller is configured to predict a load size based upon the dry distance value and confirm the predicted load sized based upon the wet distance value. In addition, in some embodiments, the controller further configured to determine a fabric type based upon variations between the dry and wet distance values and dynamically configure the one or more settings based upon the determined fabric type. In some embodiments, the controller is configured to dynamically configure the one or more settings of the wash cycle to enable or disable out-of-balance checking during a spin phase of the wash cycle, and in some embodiments, the controller is configured to dynamically configure the one or more settings of the wash cycle to control an amount of water dispensed during a fill phase of the wash cycle. Further, in some embodiments, the controller is further configured to detect excessive fluid level in the wash tub, excessive foaming in the wash tub, or a floating item in the wash tub using the distance sensor.

Consistent with another aspect of the invention, a method of operating a laundry washing machine of the type including a wash tub disposed within a housing and a water inlet configured to dispense water into the wash tub may include sensing a first distance in the wash tub using a distance sensor, the first distance associated with a height of a load disposed in the wash tub, dispensing water into the wash tub after sensing the first distance, sensing a second distance in the wash tub using the distance sensor after dispensing the water into the wash tub, the second distance associated with a height of the load after dispensing the water into the wash tub, determining dry and wet distance values respectively based upon the first and second distances, and dynamically configuring one or more settings of the wash cycle based upon the determined dry and wet distance values.

Consistent with yet another aspect of the invention, a method of operating a laundry washing machine of the type including a wash tub disposed within a housing and a water inlet configured to dispense water into the wash tub may include sensing, using a distance sensor oriented to sense a distance in the wash tub, excessive fluid level in the wash tub, excessive foaming in the wash tub, or a floating item in the wash tub during a wash cycle, and dynamically modifying the wash cycle in response to sensing the excessive fluid level in the wash tub, excessive foaming in the wash tub, or floating item in the wash tub.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

DETAILED DESCRIPTION

Figure 1:
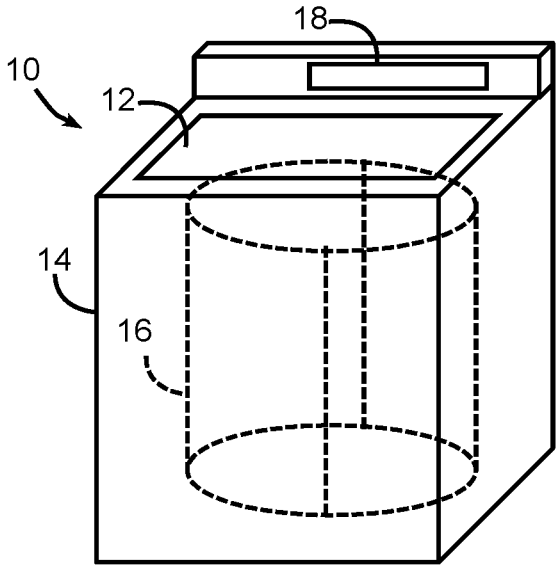
FIG. 1 is a perspective view of a top-load laundry washing machine consistent with some embodiments of the invention.

Embodiments consistent with the invention may be used to dynamically configure one or more settings of a wash cycle based at least in part on distance sensed by a distance sensor oriented to sense distance within a wash tub. In some embodiments, for example, a distance sensor may be used to determine dry and wet distance values associated with a height of a load disposed in a wash tub respectively before and after water has been dispensed into the wash tub, such that one or more settings of a wash cycle may be dynamically configured based upon the dry and wet distance values. As will become more apparent below, dry and wet distance values may be used in some instances to determine a fabric type and/or a load size such that various operating settings of a wash cycle may be dynamically adapted for different loads. Further, as will also become more apparent below, sensed distance from a distance sensor may also be used in some instances to detect potential out-of-balance load conditions and/or various potentially problematic conditions such as excessive fluid level, excessive foaming, or a floating item in a wash tub.

In some embodiments, for example, sensed distances may be used in the determination of a load type, which may be considered to represent one of a plurality of different characteristics, categories, classes, subclasses, etc. that may be used to distinguish different loads from one another, and for which it may be desirable to define particular operational settings or combinations of operational settings for use in washing loads of that particular load type. Load types may be defined, for example, to distinguish between colors, darks, whites, etc.; between different fabric types (e.g., natural, cotton, wool, silk, synthetic, polyester, permanent press, wrinkle resistant, blends, etc.); between different article types (e.g., garments, towels, bedding, delicates, etc.); between lightly, normally or heavily soiled loads; etc. Load types may also represent categories of loads that are unnamed, and that simply represent a combination of characteristics for which certain combinations operational settings may apply, particularly as it will be appreciated that some loads may be unsorted and may include a combination of different items that themselves have different characteristics. Therefore, in some embodiments, a load type may be associated with a combination of operational settings that will be applied to a range of different loads that more closely match that load type over other possible load types.

An operational setting, in this regard, may include any number of different configurable aspects of a wash cycle performed by a laundry washing machine including, but not limited to, a wash water temperature, a rinse water temperature, a wash water amount, a rinse water amount, a speed or stroke of agitation during washing and/or rinsing, a spin speed, whether or not agitation is used during washing and/or rinsing, a duration of a wash, rinse, soak, or spin phase of a wash cycle, a number of repeats of a wash, rinse, soak or spin phase, selection between different rinse operation types such as a spray rinse operation or a deep fill rinse operation, pre-treatment such as soaking over time with a prescribed water temperature and specific agitation stroke, periodic checking of out-of-balance conditions during spinning, etc. Further, dynamically configured may be considered to incorporate the configuration of a wash cycle based at least upon some data that is determined after the wash cycle has been started, i.e., not solely based upon data input by a user through a user interface.

Numerous variations and modifications will be apparent to one of ordinary skill in the art, as will become apparent from the description below. Therefore, the invention is not limited to the specific implementations discussed herein.

Turning now to the drawings, wherein like numbers denote like parts throughout the several views, FIG. 1 illustrates an example laundry washing machine 10 in which the various technologies and techniques described herein may be implemented. Laundry washing machine 10 is a top-load washing machine, and as such includes a top-mounted door 12 in a cabinet or housing 14 that provides access to a vertically-oriented wash tub 16 housed within the cabinet or housing 14. Door 12 is generally hinged along a side or rear edge and is pivotable between the closed position illustrated in FIG. 1 and an opened position (not shown). When door 12 is in the opened position, clothes and other washable items may be inserted into and removed from wash tub 16 through an opening in the top of cabinet or housing 14. Control over washing machine 10 by a user is generally managed through a control panel 18 disposed on a backsplash and implementing a user interface for the washing machine, and it will be appreciated that in different washing machine designs, control panel 18 may include various types of input and/or output devices, including various knobs, buttons, lights, switches, textual and/or graphical displays, touch screens, etc. through which a user may configure one or more settings and start and stop a wash cycle.

Figure 2:
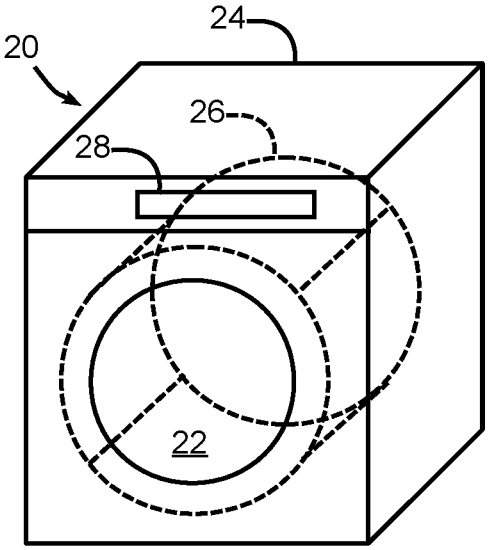
FIG. 2 is a perspective view of a front-load laundry washing machine consistent with some embodiments of the invention.

The embodiments discussed hereinafter will focus on the implementation of the hereinafter-described techniques within a top-load residential laundry washing machine such as laundry washing machine 10, such as the type that may be used in single-family or multi-family dwellings, or in other similar applications. However, it will be appreciated that the herein-described techniques may also be used in connection with other types of laundry washing machines in some embodiments. For example, the herein-described techniques may be used in commercial applications in some embodiments. Moreover, the herein-described techniques may be used in connection with other laundry washing machine configurations, including combined washer/dryers and other washing machine designs. FIG. 2, for example, illustrates a front-load laundry washing machine 20 that includes a front-mounted door 22 in a cabinet or housing 24 that provides access to a horizontally-oriented wash tub 26 housed within the cabinet or housing 24, and that has a control panel 28 positioned towards the front of the machine rather than the rear of the machine as is typically the case with a top-load laundry washing machine. Implementation of the herein-described techniques selection within a front-load laundry washing machine would be well within the abilities of one of ordinary skill in the art having the benefit of the instant disclosure, so the invention is not limited to the top-load implementation discussed further herein.

Figure 3:
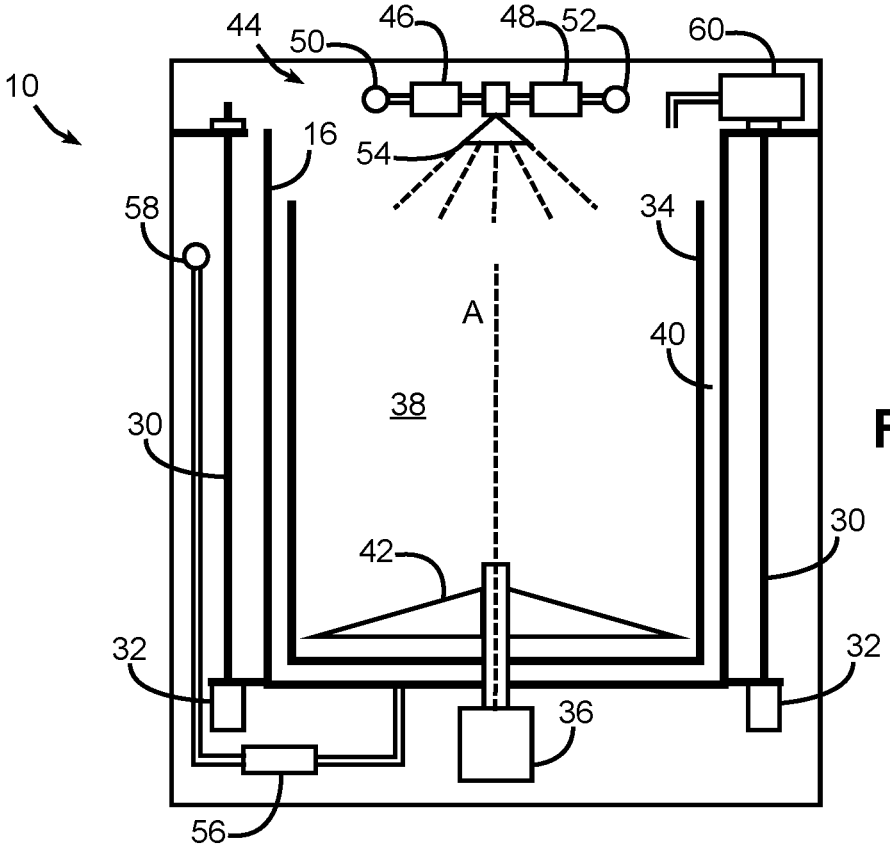
FIG. 3 is a functional vertical section of the laundry washing machine of FIG. 1.

FIG. 3 functionally illustrates a number of components in laundry washing machine 10 as is typical of many washing machine designs. For example, wash tub 16 may be vertically oriented, generally cylindrical in shape, opened to the top and capable of retaining water and/or wash liquor dispensed into the washing machine. Wash tub 16 may be supported by a suspension system such as a set of support rods 30 with corresponding vibration damper cylinders 32.

Disposed within wash tub 16 is a wash basket 34 that is rotatable about a generally vertical axis A by a drive system 36. Wash basket 34 is generally perforated or otherwise provides fluid communication between an interior 38 of the wash basket 34 and a space 40 between wash basket 34 and wash tub 16. Drive system 36 may include, for example, an electric motor and a transmission and/or clutch for selectively rotating the wash basket 34. In some embodiments, drive system 36 may be a direct drive system, whereas in other embodiments, a belt or chain drive system may be used.

In addition, in some embodiments an agitator 42 such as an impeller, auger or other agitation element may be disposed in the interior 38 of wash basket 34 to agitate items within wash basket 34 during a washing operation. Agitator 42 may be driven by drive system 36, e.g., for rotation about the same axis as wash basket 34, and a transmission and/or clutch within drive system 36 may be used to selectively rotate agitator 42. In other embodiments, separate drive systems may be used to rotate wash basket 34 and agitator 42.

A water inlet 44 may be provided to dispense water into wash tub 16. In some embodiments, for example, hot and cold valves 46, 48 may be coupled to external hot and cold water supplies through hot and cold inlets 50, 52, and may output to one or more nozzles 54 to dispense water of varying temperatures into wash tub 16. In addition, a pump system 56, e.g., including a pump and an electric motor, may be coupled between a low point, bottom or sump in wash tub 16 and an outlet 58 to discharge greywater from wash tub 16. In some embodiments, laundry washing machine 10 may also include a dispensing system 60 configured to dispense detergent, fabric softener and/or other wash-related products into wash tub 16, either from a bulk supply storing sufficient products for dispensing to multiple loads or from a single-use supply filled by a user prior to the start of a wash cycle.

Further, laundry washing machine 10 may also include various sensors for use in at least partially automating a wash cycle, e.g., one or more of a weight sensor, a fluid level sensor, a fluid property sensor and a flow sensor. A weight sensor may be used to generate a signal that varies based in part on the mass or weight of the contents of wash tub 16. A fluid level sensor may be used to generate a signal that varies with the level or height of fluid in wash tub 16, and as will be discussed in greater detail below, a fluid level sensor may be implemented using a distance sensor capable of determining a height of a surface of the fluid in the wash tub, among other purposes. A fluid property sensor, e.g., a turbidity sensor, may be used in some embodiments to measure one or more of the turbidity, clarity, conductivity or temperature of the fluid in wash tub 16, e.g., to sense the presence or relative amount of various wash-related products such as detergents or fabric softeners and/or to sense the presence or relative amount of soil in the fluid. A flow sensor, e.g., one or more flowmeters, may be used to sense an amount of water dispensed into wash tub 16. Representative locations of these various types of sensors are not illustrated in FIG. 3 for reasons of simplifying the discussion; however, the various locations and configurations of such sensors will be apparent to those of ordinary skill having the benefit of the instant disclosure. It will be also be appreciated that some or all of these sensors may be omitted in some embodiments.

It will be appreciated that the particular components and configuration illustrated in FIG. 3 is typical of a number of common laundry washing machine designs. Nonetheless, a wide variety of other components and configurations are used in other laundry washing machine designs, and it will be appreciated that the herein-described functionality generally may be implemented in connection with these other designs, so the invention is not limited to the particular components and configuration illustrated in FIG. 3.

Figure 4:
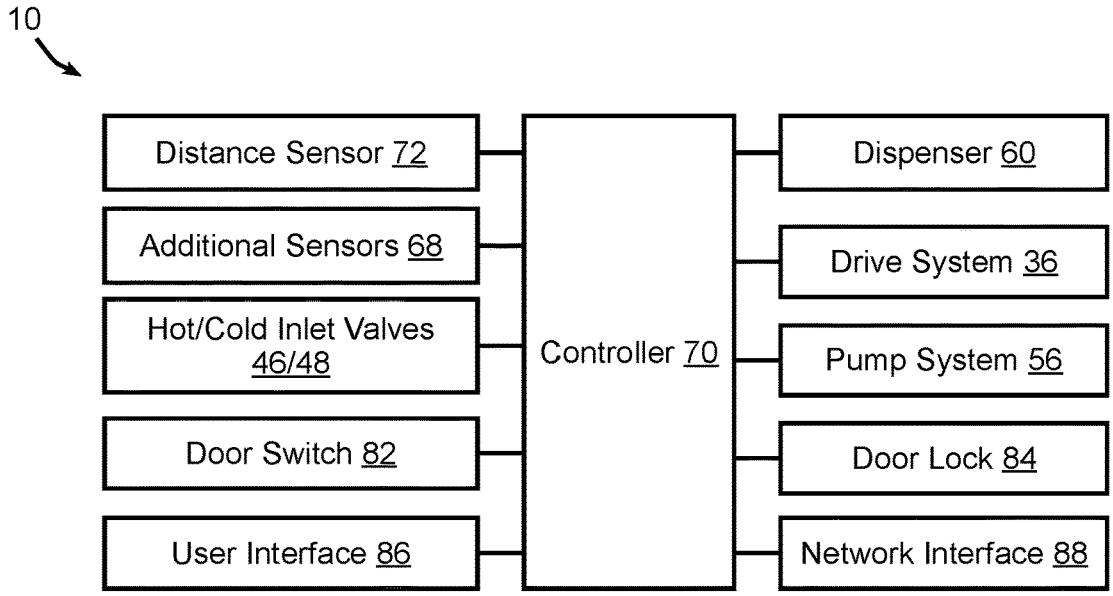
FIG. 4 is a block diagram of an example control system for the laundry washing machine of FIG. 1.

Now turning to FIG. 4, laundry washing machine 10 may be under the control of a controller 70 that receives inputs from a number of components and drives a number of components in response thereto. Controller 70 may, for example, include one or more processors and a memory (not shown) within which may be stored program code for execution by the one or more processors. The memory may be embedded in controller 70, but may also be considered to include volatile and/or non-volatile memories, cache memories, flash memories, programmable read-only memories, read-only memories, etc., as well as memory storage physically located elsewhere from controller 70, e.g., in a mass storage device or on a remote computer interfaced with controller 70.

As shown in FIG. 4, controller 70 may be interfaced with various components, including the aforementioned drive system 36, hot/cold inlet valves 46, 48, pump system 56, additional sensors (e.g., weight, fluid property, flow, acceleration, temperature, etc., collectively represented at 68), and a distance sensor 72. In addition, controller 70 may be interfaced with additional components such as a door switch 82 that detects whether door 12 is in an open or closed position and a door lock 84 that selectively locks door 12 in a closed position. Moreover, controller 70 may be coupled to a user interface 86 including various input/output devices such as knobs, dials, sliders, switches, buttons, lights, textual and/or graphics displays, touch screen displays, speakers, image capture devices, microphones, etc. for receiving input from and communicating with a user. In some embodiments, controller 70 may also be coupled to one or more network interfaces 88, e.g., for interfacing with external devices via wired and/or wireless networks such as Ethernet, Bluetooth, NFC, cellular and other suitable networks. Additional components may also be interfaced with controller 70, as will be appreciated by those of ordinary skill having the benefit of the instant disclosure. Moreover, in some embodiments, at least a portion of controller 70 may be implemented externally from a laundry washing machine, e.g., within a mobile device, a cloud computing environment, etc., such that at least a portion of the functionality described herein is implemented within the portion of the controller that is externally implemented.

In some embodiments, controller 70 may operate under the control of an operating system and may execute or otherwise rely upon various computer software applications, components, programs, objects, modules, data structures, etc. In addition, controller 70 may also incorporate hardware logic to implement some or all of the functionality disclosed herein. Further, in some embodiments, the sequences of operations performed by controller 70 to implement the embodiments disclosed herein may be implemented using program code including one or more instructions that are resident at various times in various memory and storage devices, and that, when read and executed by one or more hardware-based processors, perform the operations embodying desired functionality. Moreover, in some embodiments, such program code may be distributed as a program product in a variety of forms, and that the invention applies equally regardless of the particular type of computer readable media used to actually carry out the distribution, including, for example, non-transitory computer readable storage media. In addition, it will be appreciated that the various operations described herein may be combined, split, reordered, reversed, varied, omitted, parallelized and/or supplemented with other techniques known in the art, and therefore, the invention is not limited to the particular sequences of operations described herein.

Figure 5:
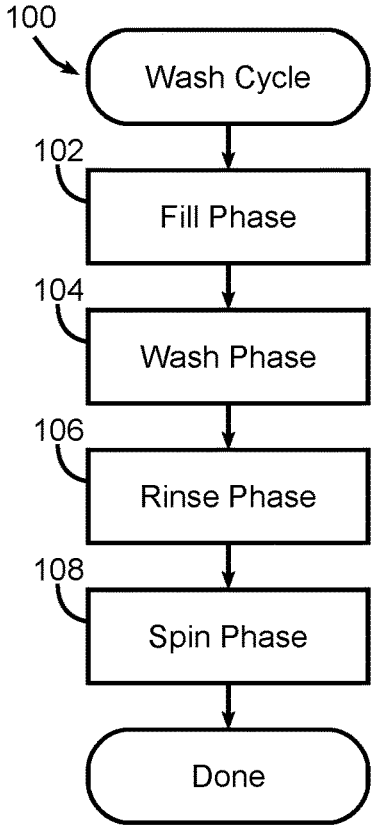
FIG. 5 is a flowchart illustrating an example sequence of operations for implementing a wash cycle in the laundry washing machine of FIG. 1.

Now turning to FIG. 5, and with continuing reference to FIGS. 3-4, a sequence of operations 100 for performing a wash cycle in laundry washing machine 10 is illustrated. A typical wash cycle includes multiple phases, including an initial fill phase 102 where the wash tub is initially filled with water, a wash phase 104 where a load that has been placed in the wash tub is washed by agitating the load with a wash liquor formed from the fill water and any wash products added manually or automatically by the washing machine, a rinse phase 106 where the load is rinsed of detergent and/or other wash products (e.g., using a fill rinse where the wash tub is filled with fresh water and the load is agitated and/or a spray rinse where the load is sprayed with fresh water while spinning the load), and a spin phase 108 where the load is spun rapidly while water is drained from the wash tub to reduce the amount of moisture in the load.

It will be appreciated that wash cycles can also vary in a number of respects. For example, additional phases, such as a pre-soak phase, may be included in some wash cycles, and moreover, some phases may be repeated, e.g., including multiple rinse and/or spin phases. Each phase may also have a number of different operational settings that may be varied for different types of loads, e.g., different times or durations, different water temperatures, different agitation speeds or strokes, different rinse operation types, different spin speeds, different water amounts, different wash product amounts, etc.

Figure 6:
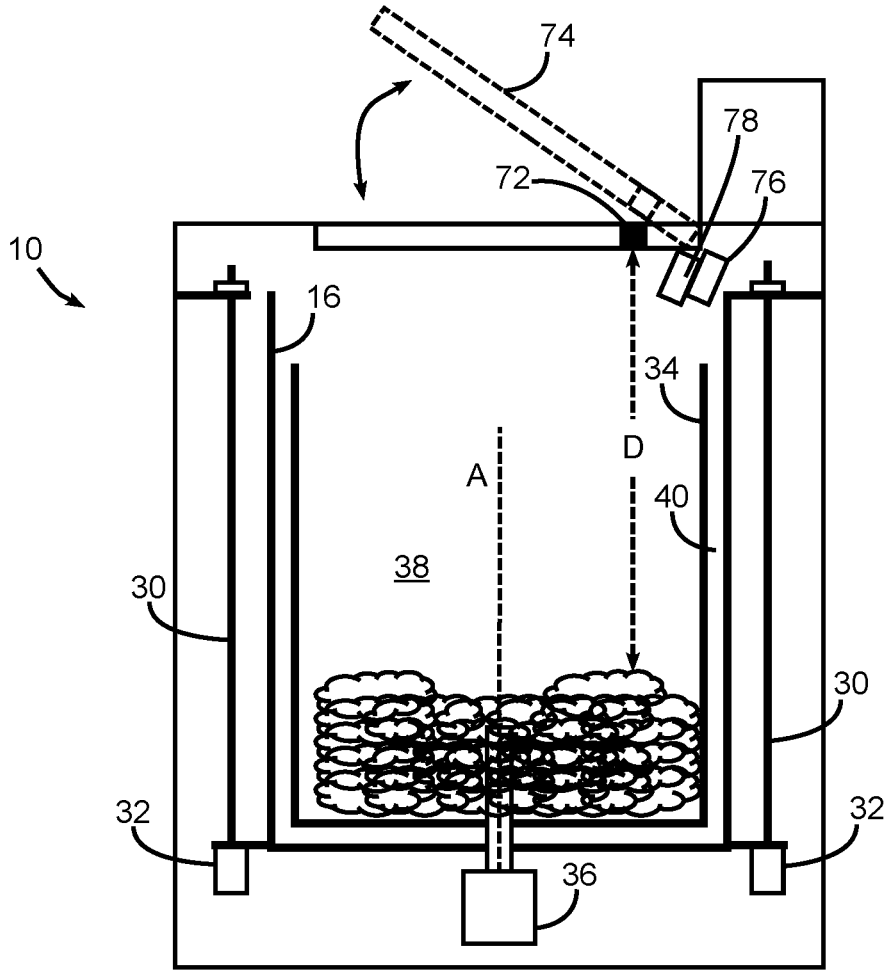
FIG. 6 is a functional vertical section of the laundry washing machine of FIG. 1, additionally illustrating a distance sensor for use in accordance with various techniques disclosed herein.

As noted above, one or more distance sensors may also be incorporated into a laundry washing machine to sense a distance that varies with the height of a load disposed in a wash tub. FIG. 6, for example, illustrates one implementation of a distance sensor within laundry washing machine 10, here implemented as a laser distance sensor 72. Laser distance sensor 72 is mounted on the underside of a hinged lid or door 74 providing access to the interior compartment 38 of machine 10, and is oriented to sense a distance D within the wash tub 16. In some embodiments, controller 70 may be configured to automatically disable sensor 72 when door 74 is in an open position.

Laser distance sensor may sense a distance from a reference point, e.g., the elevation of the sensor, and in a direction toward a bottom of wash tub 16. In some embodiments, the direction may be substantially parallel to generally vertical axis A, while in other embodiments, the direction may be angled relative to axis A. In some embodiments, multiple distance sensors may be used, e.g., to sense distance at a plurality of radial offsets from axis A. In addition, while laser distance sensor 72 is illustrated on the underside of a door, in other embodiments, sensor 72 may be positioned and oriented in other locations relative to an interior compartment of a laundry washing machine.

In addition, in some embodiments the multiple distance sensors may be different types of sensors. Each distance sensor may be implemented, for example, as a laser distance sensor, an ultrasonic distance sensor, a digital camera, a three-dimensional imaging sensor, or any other type of sensor capable of sensing a distance from a reference point.

Further, in some instances a distance sensor may also be configured to image a top profile of a load, e.g., a three-dimensional representation of a top surface of the load. Such a sensor, for example, may be suitable for determining a potential out-of-balance load due to variations in height in the load. FIG. 6, for example, illustrates a digital camera 76 oriented to image a top surface of the load, although it will be appreciated that digital camera 76 is optional. In addition, in some embodiments it may also be desirable to include an illumination source 78, e.g., a visible light, infrared, or other illumination source to assist digital camera 76 in imaging the load when door 74 is closed.

Laser distance sensor 72 may be used to determine one or more distance values representative of the height of a load in wash tub 16, among other purposes that will be discussed in greater detail below. FIGS. 7-11, for example, illustrate various distance values that may be determined using a distance sensor in some embodiments of the invention. Among these distance values include one or more dry distance values, associated with the height of the load prior to dispensing water into the wash tub, as well as one or more wet distance values, associated with the height of the load after dispensing water into the wash tub. It will be appreciated that a distance value may be considered to be a dry distance value even if some amount of water is dispensed into a wash tub, so long as the amount dispensed is not sufficient to cause appreciable absorption of water into the load. Likewise, a distance value may be considered to be a wet distance value even if additional water is dispensed into the wash tub and absorbed by the load after the distance value is determined.

Figure 7:
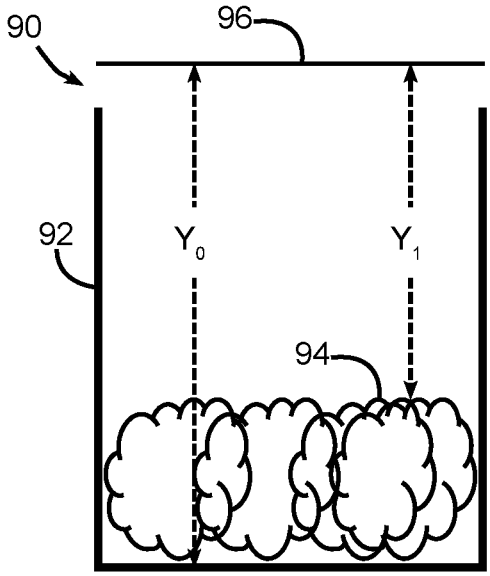
FIGS. 7-11 functionally illustrate various distances capable of being measured with a distance sensor in accordance with various techniques disclosed herein.

As shown in FIG. 7, for example, a laundry washing machine 90 may include a wash basket 92 within which is disposed a load 94. Distance values may be determined from a common reference point, e.g., as disposed along a fixed elevation 96 relative to wash basket 92 (such as the elevation of a distance sensor).

FIG. 7 illustrates two distance values, $Y_0$ and $Y_1$. Distance value $Y_0$ represents a distance to a base of the wash basket 92 upon which load 94 is supported, and may be determined, for example, by sensing with a distance sensor when the laundry washing machine is empty. In other embodiments, $Y_0$ may be determined during manufacture, e.g., during calibration, while in other embodiments, the distance may be a constant value defined for the machine.

Figure 8:
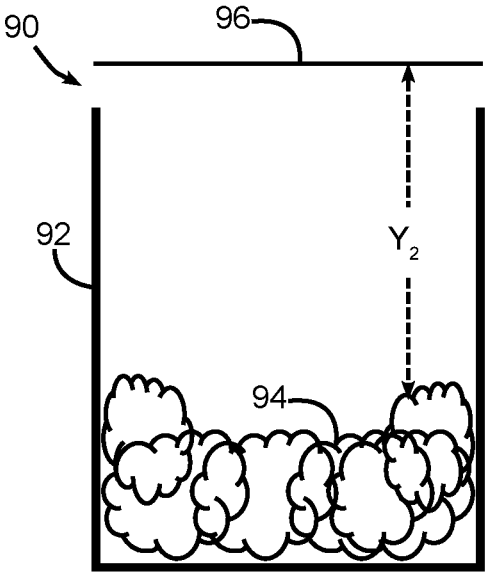

Distance value $Y_1$ is a dry distance value, and is associated with an initial height of the load, and typically at the start of a wash cycle. In some implementations, a single dry distance value may be used, while in other embodiments, multiple dry distance values may be determined. FIG. 8, for example, illustrates a second dry distance value $Y_2$, which may be determined, for example, based upon a distance sensed by a distance sensor after the wash basket has been spun for some period of time and at a rate sufficient to apply centrifugal force to the load and urge the load against the sidewalls of the wash basket. In some embodiments, the change in the height and/or top profile of the load as a result of spinning the load while in a dry condition may be used as an indicator of load type, fabric type and/or load size, and thus a comparison of the $Y_1$ and $Y_2$ values may be a discriminator for one or more of these load characteristics.

Figure 9:
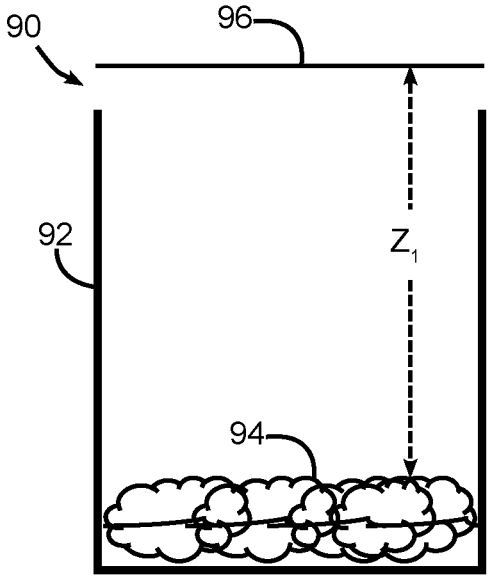

FIG. 9 illustrates a wet distance value $Z_1$, and is associated with a height of the load after some amount of water is dispensed into the wash tub and absorbed into the load. It will be appreciated that multiple wet distance values may be determined in some embodiments, e.g., at different fill levels and/or times to enable a rate of absorption to be determined.

Each of the distance values may be based upon single sensor measurements in some embodiments, while in other embodiments, distance values may be based on multiple sensor measurements. For example, in some embodiments multiple distance measurements may be taken during rotation of the wash basket such that the distance measurements are taken at multiple points along a circular path at a fixed radius about axis A. A distance value may then be a function of the multiple measurements, e.g., an average, a maximum, a minimum, etc. Furthermore, multiple distance values may be determined from common distance measurements, e.g., where a wet distance value is determined as an average of multiple distance measurements, and a variation between maximum and minimum distance measurements may be used as an indication of a potential out-of-balance condition.

Figure 10:
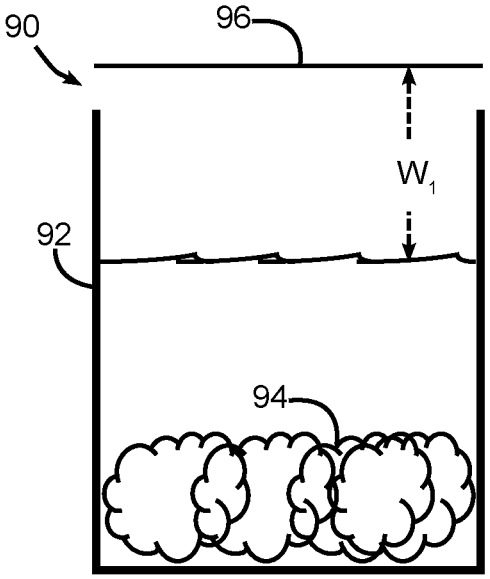
Figure 11:
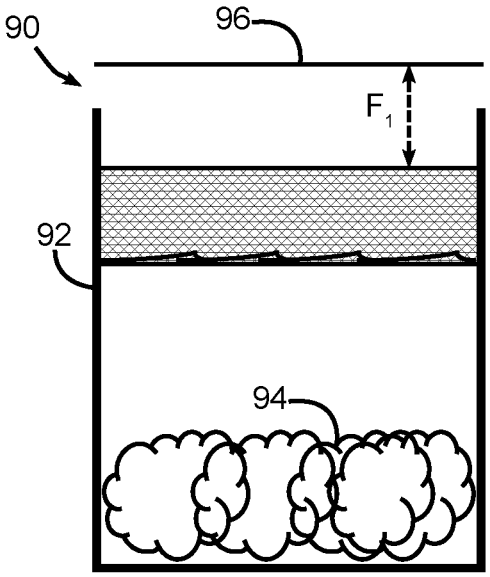

FIGS. 10 and 11 also illustrate additional conditions that may be detected with a distance sensor consistent with the invention. FIG. 10, for example, illustrates a fluid level distance value $W_1$ associated with a water or fluid level in the wash tub. In addition to use in some embodiments as a fluid level sensor, the $W_1$ value may also be used in some embodiments to detect a potential excessive fluid level in the wash tub. FIG. 11 illustrates an excessive foam distance value $F_1$ associated with excessive foaming in the wash tub. Either distance value may also, in some instances, be capable of detecting floating items in the wash tub. As each of excessive fluid level, excessive foaming, and floating items may result in spillage of fluid out of the wash tub and potential flooding from a laundry washing machine, a distance sensor may therefore in some embodiments be used to detect these conditions and dynamically modify a wash cycle to address the detected condition, e.g., by halting the cycle and/or alerting an operator of the detected condition.

Now turning to FIGS. 12-15, an example sequence of operations 120 suitable for implementation of a wash cycle by controller 70 of laundry washing machine 10 is illustrated in greater detail. The sequence begins in block 122, in an initial state where the laundry washing machine is plugged in and powered on, and the door or lid is open. In block 124, closing of the lid after a user has placed a load in the wash tub is detected once the user has started the wash cycle (e.g., by selecting a "start" button on a control panel). At this time, any user-configured operational settings (e.g., load size, temperature, fabric type, soil level, etc.) may also be stored for later use during the wash cycle (block 126).

Next, in block 128, one or more dry load distance measurements are taken to determine one or more dry distance values. As noted, above, the dry distance values may be determined prior to dispensing water into the wash tub in some embodiments, so after determining the dry distance values, block 130 may start a fill phase of the wash cycle and begin dispensing water into the wash tub. Block 132 then takes one or more wet load distance measurements and determines one or more wet distance values. Thereafter, in block 134 the distance-based data determined in blocks 128 and 132, including the dry and wet distance values, may be used to dynamically configure one or more operational settings for the wash cycle, and in some embodiments, these configured operational settings may be used in connection with one or more additional operational settings from block 126 to complete the wash cycle.

A wash cycle may be dynamically configured based upon distance measurements in a number of different manners in different embodiments. For example, dry and wet distance values may be used to determine a load size, from which various operational settings, e.g., fill volumes (e.g., the amount of water dispensed during a fill phase), spin speeds, out-of-balance checking, etc. may be varied. In one embodiment discussed hereinafter, for example, a load size may initially be predicted based upon the dry distance value, and then the predicted load size may be confirmed based upon the wet distance value. In addition, in some embodiments a fabric type may be determined based upon variations between dry and wet distance values, as some types of fabrics, are more absorptive than others and will cause greater variations between dry and wet distance values due to the amount and/or rate of absorption of water.

In addition, as illustrated by block 136, during performance of the wash cycle, distance measurements may also be used to monitor for various conditions, e.g., out-of-balance, excessive fluid level, excessive foaming, floating items, etc., and to address those conditions through halting the cycle and/or alerting an operation, e.g., via a control panel, audible and/or visual alerts, electronic messages to a user's computer, mobile device, etc. In addition, in some instances, these conditions may also be based on additional sensor input. For example, in some embodiments, foaming may also be detected based in part on color or texture through image analysis with digital camera 76, with the foaming detection combined with a distance measurement to determine when foaming has reached an excessively high level.

The manner in which dry and wet measurements are taken and used to determine dry and wet distance values may vary in different embodiments. FIG. 13, for example, illustrates one implementation of block 128 of FIG. 12. In this implementation, in block 140 the wash basket is spun at a slower speed (e.g., about 20 RPM), and a first dry distance $Y_1$ is determined while the wash basket is spinning, e.g., by averaging together multiple measurements taken while spinning the wash basket. In addition, a first dry distance ratio ($Y_1/Y_0$) is determined as the ratio between $Y_1$ and $Y_0$, the distance to the base of the wash basket (and thus, the distance that would be expected were the wash basket empty).

Next, in block 142, the spin speed is temporarily increased to a higher speed (e.g., about 50 RPM) for a predetermined period of time $X_1$, and then the wash basket may be allowed to coast back to the original slower speed, with the motor current for the drive current summed over this time period to determine an indication of the inertial mass of the load. Then, in block 144, a second dry distance $Y_2$ may be determined, and a second dry distance ratio ($Y_2/Y_0$) may be calculated therefrom. In some embodiments, $Y_2$ may be taken from a maximum distance (i.e., shortest height) detected by the distance sensor.

Next, block 146 may predict a dry load size based on the calculated dry distance ratios and zero or more of a current sub, coast time or other operational setting. In some embodiments, for example, a small load size may be predicted based upon the first dry distance ratio ($Y_1/Y_0$) being greater than the second dry distance ratio ($Y_2/Y_0$). Otherwise, a large load size may be predicted based upon the second dry distance ratio exceeding a limit (e.g., $Y_2/Y_0$>limit($Y_1/Y_0$)), with ratios not meeting either condition being classified as of medium load size. The limit may be determined empirically or in other manners. In addition, in other embodiments additional factors, e.g., the summed motor current, may also be used in connection with the distance ratios to determine load size. Next, in block 148 one or more settings may be selected for the wash cycle based on the predicted dry load size and any other operational settings configured by a user, e.g., fill time and/or amount, agitator strokes and time, etc. In addition, a limit for use in wet distance calculations may also be determined at this time.

Figure 12:
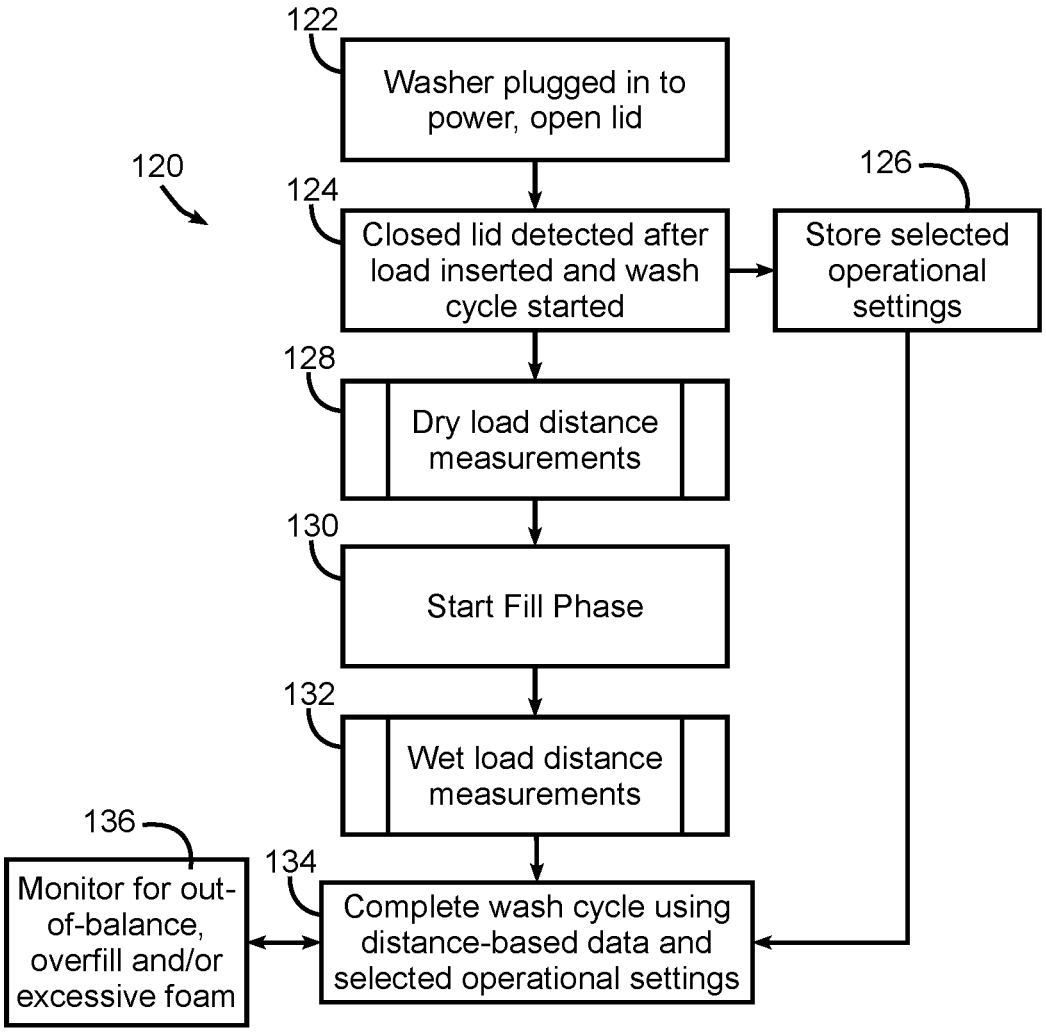
FIG. 12 is a flowchart illustrating an example sequence of operations for performing a wash cycle using a distance sensor in the laundry washing machine of FIG. 1.
Figure 13:
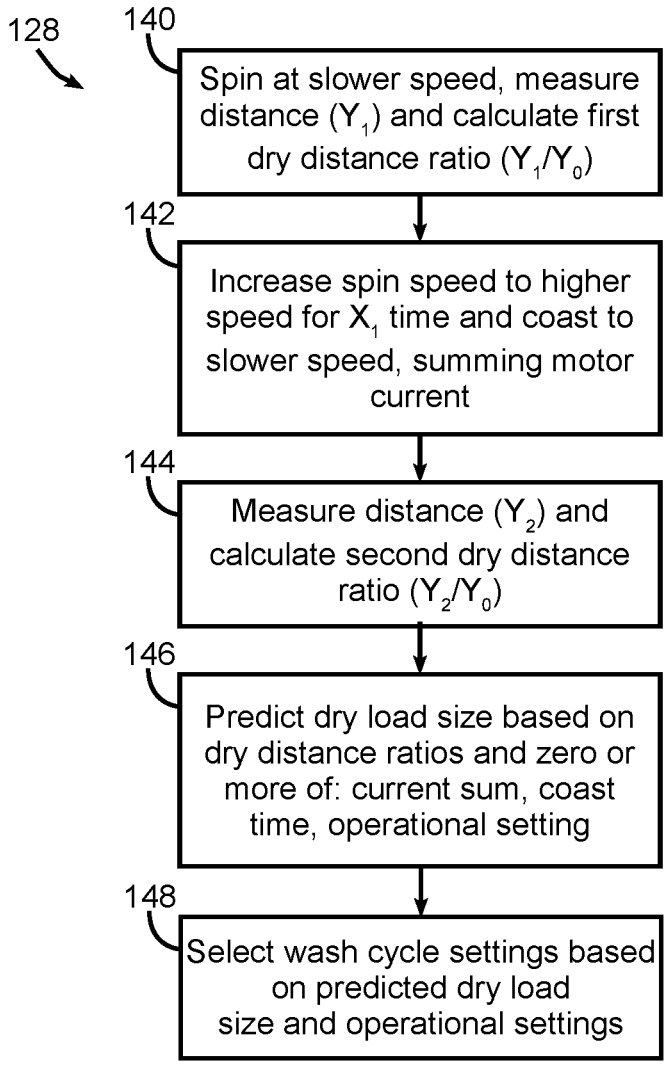
FIG. 13 is a flowchart illustrating an example sequence of operations for implementing the dry load distance measurements block referenced in FIG. 12.
Figure 14:
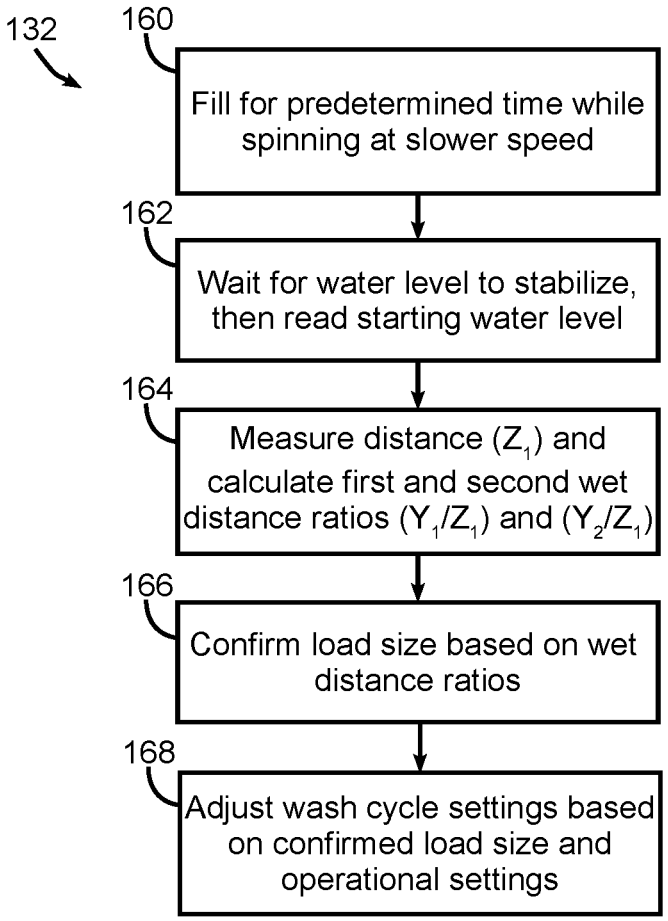
FIG. 14 is a flowchart illustrating an example sequence of operations for implementing the wet load distance measurements block referenced in FIG. 12.

FIG. 14 next illustrates an example implementation of block 132 of FIG. 12 for determining a wet distance value. In block 160, an initial fill may be initiated for a predetermined time (e.g., about 15 seconds), and using temperature control to dispense the water at a desired temperature. During this time, the wash basket may also be spun at a lower speed (e.g., about 20 RPM). Next, block 162 may wait for the water level to stabilize, and then begin read distance sensor measurements to determine a starting water level. Block 164 may then measure the wet distance value $Z_1$ and calculate therefrom two wet distance ratios ($Y_1/Z_1$) and ($Y_2/Z_1$). If ($Y_1/Z_1$) is greater than ($Y_2/Z_1$), then a large load size is indicated, while if it is less, a small load size is indicated. Thus, based upon these ratios block 166 may confirm or update the load size determined from the dry distance ratios using the wet distance ratios. Block 168 then adjusts settings for the wash cycle based upon the confirmed load size and any other operational settings.

Figure 15:
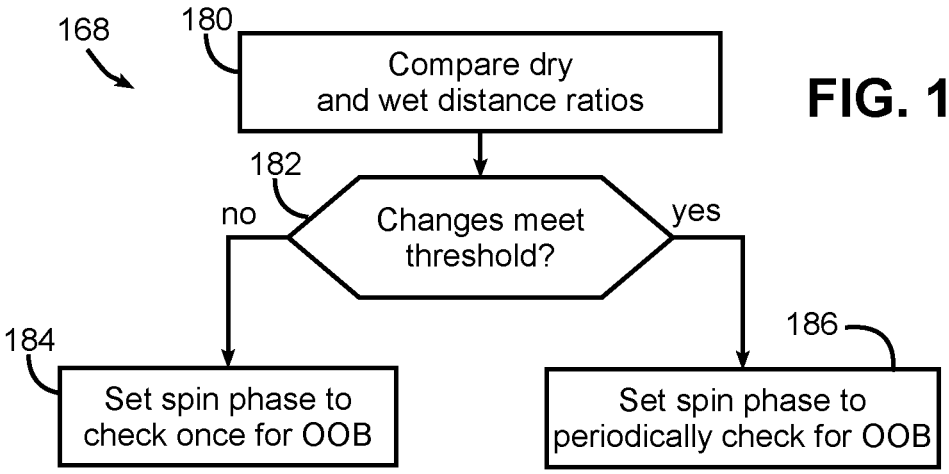
FIG. 15 is a flowchart illustrating an example sequence of operations for implementing the adjust wash cycle settings block referenced in FIG. 12.

Now turning to FIG. 15, while various operational settings may be dynamically configured using distance sensor measurements in different embodiments, in this figure an example implementation of block 168 of FIG. 12 is illustrated based upon the selective enabling or disabling of out-of-balance checking during a spin phase of a wash cycle. It will be appreciated that an out-of-balance load can cause vibrations during a spin phase due to the mass of the load being unevenly distributed within a wash basket. Such vibrations can cause excessive noise and shaking in the machine that may even propagate to the floor on which the laundry washing machine rests. Furthermore, such vibrations can cause excessive wear and stress on laundry washing machine components.

As a result of the desire to limit such conditions, some wash cycles implement periodic out-of-balance checking, during which the spin speed during a spin phase is periodically reduced and/or controlled to run at a lower speed in order to minimize out-of-balance forces. While for larger loads such checking may useful, out-of-balance checking otherwise increases cycle time, and for smaller loads is generally unnecessary. Thus, as illustrated in block 180, dry and wet distance ratios may be compared in some embodiments, and if the changes meet some threshold (e.g., an empirically-determined threshold), block 182 may pass control to either block 184 or block 186 to configure the spin phase to either disable or enable periodic out-of-balance checking. Block 184, for example, may set the spin phase to only perform a single out-of-balance check at the beginning of a spin phase when the threshold is not met (e.g., when there is a low likelihood of an out-of-balance condition developing), while block 186 may set the spin phase to perform periodic out-of-balance checks when the threshold is met (e.g., when there is a higher likelihood of an out-of-balance condition developing).

Various additional modifications may be made to the illustrated embodiments consistent with the invention. Therefore, the invention lies in the claims hereinafter appended.

What is claimed is:

1. A method of operating a laundry washing machine of the type including a wash tub disposed within a housing and a water inlet configured to dispense water into the wash tub, the method comprising:

sensing a first distance in the wash tub using a distance sensor, the first distance associated with a height of a load disposed in the wash tub;

dispensing water into the wash tub after sensing the first distance;

sensing a second distance in the wash tub using the distance sensor after dispensing the water into the wash tub, the second distance associated with a height of the load after dispensing the water into the wash tub;

determining a dry distance value based upon the first distance and determining a wet distance value based upon the second distance;

dynamically configuring one or more settings of a wash cycle based upon the determined dry and wet distance values by selectively enabling out-of-balance checking during a spin phase of the wash cycle based upon the determined dry and wet distance values; and performing the wash cycle in the laundry washing machine using the dynamically configured one or more settings.

2. The method of claim 1, further comprising rotating a rotatable wash basket disposed in the wash tub, wherein sensing the first and second distances is performed during rotation of the wash basket.

3. The method of claim 2, further comprising sensing a potential out-of-balance load based upon distance variations sensed by the distance sensor during rotation of the wash basket.

4. The method of claim 2, wherein the dry distance value is a first dry distance value, wherein the method further includes, after sensing the first distance, temporarily increasing a rotational speed of the wash basket and determining a second dry distance value based upon a distance sensed by the distance sensor after temporarily increasing the rotational speed of the wash basket, and wherein dynamically configuring the one or more settings of the wash cycle is further based upon the second dry distance value.

5. The method of claim 4, wherein the first and second dry distance values and the wet distance value are each based upon distance from a reference point to a top surface of the load, the method further comprising:

determining a first dry distance ratio between the first dry distance value and a distance from the reference point to a base of the wash basket;

determining a second dry distance ratio between the second dry distance value and a distance from the reference point to a base of the wash basket;

determining a first wet distance ratio between the first dry distance value and the wet distance value; and determining a second wet distance ratio between the second dry distance value and the wet distance value;

wherein dynamically configuring the one or more settings of the wash cycle is based upon the first and second dry distance ratios and the first and second wet distance ratios.

6. The method of claim 2, further comprising determining a load size based upon the dry and wet distance values by predicting a load size based upon the dry distance value and confirming the predicted load sized based upon the wet distance value.

7. The method of claim 2, further comprising determining a fabric type based upon variations between the dry and wet distance values, wherein dynamically configuring the one or more settings is based upon the determined fabric type.

8. The method of claim 2, further comprising detecting excessive fluid level in the wash tub, excessive foaming in the wash tub, or a floating item in the wash tub using the distance sensor.

9. The method of claim 1, wherein the distance sensor is a laser distance sensor, an ultrasonic distance sensor or a three-dimensional imaging sensor.

10. The method of claim 1, wherein the laundry washing machine further includes a digital camera configured to image a top profile of the load, the method further comprising detecting a potential out-of-balance load based upon the imaged top profile.

11. The method of claim 1, wherein the distance sensor is mounted on a hinged door coupled to the housing and oriented to sense the first and second distances within the wash tub when the hinged door is in a closed position, the method further comprising automatically disabling the distance sensor when the hinged door is in an open position.

12. A method of operating a laundry washing machine of the type including a wash tub disposed within a housing and a water inlet configured to dispense water into the wash tub, the method comprising:

sensing a first distance in the wash tub using a distance sensor during rotation of a wash basket disposed in the wash tub, the first distance associated with a height of a load disposed in the wash tub;

dispensing water into the wash tub after sensing the first distance;

sensing a second distance in the wash tub using the distance sensor after dispensing the water into the wash tub and during rotation of the wash basket, the second distance associated with a height of the load after dispensing the water into the wash tub;

determining a dry distance value based upon the first distance and determining a wet distance value based upon the second distance;

dynamically configuring one or more settings of a wash cycle based upon the determined dry and wet distance values;

performing the wash cycle in the laundry washing machine using the dynamically configured one or more settings; and sensing a potential out-of-balance load based upon distance variations sensed by the distance sensor during rotation of the wash basket.

13. The method of claim 12, wherein the dry distance value is a first dry distance value, wherein the method further includes, after sensing the first distance, temporarily increasing a rotational speed of the wash basket and determining a second dry distance value based upon a distance sensed by the distance sensor after temporarily increasing the rotational speed of the wash basket, and wherein dynamically configuring the one or more settings of the wash cycle is further based upon the second dry distance value.

14. The method of claim 13, wherein the first and second dry distance values and the wet distance value are each based upon distance from a reference point to a top surface of the load, the method further comprising:

determining a first dry distance ratio between the first dry distance value and a distance from the reference point to a base of the wash basket;

determining a second dry distance ratio between the second dry distance value and a distance from the reference point to a base of the wash basket;

determining a first wet distance ratio between the first dry distance value and the wet distance value; and determining a second wet distance ratio between the second dry distance value and the wet distance value;

wherein dynamically configuring the one or more settings of the wash cycle is based upon the first and second dry distance ratios and the first and second wet distance ratios.

15. The method of claim 12, further comprising determining a load size based upon the dry and wet distance values by predicting a load size based upon the dry distance value and confirming the predicted load sized based upon the wet distance value.

16. The method of claim 12, further comprising determining a fabric type based upon variations between the dry and wet distance values, wherein dynamically configuring the one or more settings is based upon the determined fabric type.

17. The method of claim 12, further comprising detecting excessive fluid level in the wash tub, excessive foaming in the wash tub, or a floating item in the wash tub using the distance sensor.

18. A method of operating a laundry washing machine of the type including a wash tub disposed within a housing and a water inlet configured to dispense water into the wash tub, the method comprising:

determining a plurality of distance values associated with a load disposed in the wash tub using a distance sensor and during rotation of a wash basket disposed in the wash tub, the plurality of distance values including at least one dry distance value associated with a height of the load in the wash tub prior to dispensing of water into the wash tub by the water inlet and at least one wet distance value associated with a height of the load in the wash tub after water is dispensed into the wash tub, and wherein at least one of the plurality of distance values is determined during rotation of the wash basket at a different speed at which another of the plurality of distance values is determined;

dynamically configuring one or more settings of a wash cycle based upon the determined plurality of distance values; and performing the wash cycle in the laundry washing machine using the dynamically configured one or more settings.

* * * * *